US008820744B1

(12) United States Patent
Lawton

(10) Patent No.: US 8,820,744 B1
(45) Date of Patent: Sep. 2, 2014

(54) RACE DAY SCRATCH PLAY GAME, GAME CARD AND METHOD OF PLAYING

(71) Applicant: Ces Lawton, Winter Park, FL (US)

(72) Inventor: Ces Lawton, Winter Park, FL (US)

(73) Assignee: Race Day Scratch Play, LLC, Winter Park, FL (US)

( * ) Notice: Subject to any disclaimer, the term of this patent is extended or adjusted under 35 U.S.C. 154(b) by 0 days.

(21) Appl. No.: 13/785,486

(22) Filed: Mar. 5, 2013

Related U.S. Application Data

(60) Provisional application No. 61/608,777, filed on Mar. 9, 2012.

(51) Int. Cl.
*A63F 3/06* (2006.01)
*G07F 17/32* (2006.01)

(52) U.S. Cl.
CPC ..... *A63F 3/0665* (2013.01); *A63F 3/064* (2013.01); *A63F 3/0615* (2013.01); *G07F 17/329* (2013.01); *G07F 17/3288* (2013.01); *Y10S 283/901* (2013.01); *Y10S 283/903* (2013.01)
USPC ..... 273/139; 273/246; 273/298; 463/6; 463/16; 463/42; 283/901; 283/903

(58) Field of Classification Search
CPC . A63F 3/0615; A63F 3/0645; G07F 17/3288; G07F 17/329; G07F 17/3293
USPC ..... 273/139, 246, 298; 463/6, 16, 42; 283/901, 903
See application file for complete search history.

(56) References Cited

U.S. PATENT DOCUMENTS

| | | | | | |
|---|---|---|---|---|---|
| 4,288,077 | A | * | 9/1981 | Rose et al. | 273/246 |
| 4,429,877 | A | * | 2/1984 | Coppock | 273/139 |
| 4,491,319 | A | * | 1/1985 | Nelson | 273/459 |
| 4,540,174 | A | * | 9/1985 | Coppock | 463/17 |
| 4,883,636 | A | * | 11/1989 | Fantle, Jr. | 273/269 |
| 4,962,950 | A | * | 10/1990 | Champion | 283/67 |

(Continued)

OTHER PUBLICATIONS

Lawton, Utility Patent Application specification and drawings for U.S. Appl. No. 13/790,242, filed Mar. 8, 2013, 33 pages.

(Continued)

*Primary Examiner* — Benjamin Layno
(74) *Attorney, Agent, or Firm* — Brian S. Steinberger; Phyllis K. Wood; Law Offices of Brian S. Steinberger, P.A.

(57) ABSTRACT

Scratch-off game cards, systems and methods of play for pre-picking winners of real-time sporting events before events take place. Each player scratches off a number of scratch-off portions from scratch off sheets to determine teams picked before the sporting event begins. Players list selected racing teams and start positions on cards before events begin. After the event concludes, players list final position numbers for the teams. Players sum up their initial position numbers to determine initial position sum scores, and players sum up their finish position numbers to determine finish position scores. The player with the lowest initial and or final position sum score wins game. Optionally, the player with the winner of the race on the player's game card wins another portion of the game. In the case of a sponsored race, the rules and method of play can vary.

22 Claims, 18 Drawing Sheets

(56) References Cited

U.S. PATENT DOCUMENTS

| | | | | |
|---|---|---|---|---|
| 5,332,218 | A * | 7/1994 | Lucey | 463/18 |
| 5,374,060 | A * | 12/1994 | Goldberg | 273/139 |
| 5,518,239 | A * | 5/1996 | Johnston | 273/139 |
| 2001/0019193 | A1 | 9/2001 | Gumina | |
| 2004/0193490 | A1 | 9/2004 | Pletz | |
| 2010/0099499 | A1 | 4/2010 | Amaitis | |
| 2012/0061951 | A1 | 3/2012 | Upshaw | |
| 2012/0077588 | A1 | 3/2012 | Apirian | |
| 2012/0122538 | A1 | 5/2012 | Pollard | |

OTHER PUBLICATIONS

Lawton, Office Action Summary received from USPTO for U.S. Appl. No. 13/790,242 mailed on Dec. 19, 2013, 19 pages.

Lawton, Amendment Response submitted to USPTO for U.S. Appl. No. 13/790,242 on Mar. 5, 2014, 15 pages.

* cited by examiner

*NASCAR Sprint Cup Series Race Number 5*
*Unofficial Race Results for the 2Nd Annual Stp 400 - Sunday, April 22, 2012*
*Kansas Speedway - Kansas City, KS - 1.5 Mile Paved*
*Total Race Length - 267 Laps - 400.5 Miles - Purse: $5,337,371*

| Fin | Str | Car | Driver | Team | Laps | Pts | Bns | Driver Rating | Winnings | Status | Leader Tms | Leader Laps |
|---|---|---|---|---|---|---|---|---|---|---|---|---|
| 1 | 4 | 11 | Denny Hamlin | FedEx Ground Toyota | 267 | 47 | 4 | 128.6 | $248,891 | Running | 2 | 32 |
| 2 | 5 | 20 | Martin Truex Jr. | Napa Auto Parts Toyota | 267 | 44 | 2 | 142.8 | $206,285 | Running | 4 | 179 |
| 3 | 15 | 48 | Jimmie Johnson | Lowe's Chevrolet | 267 | 42 | 1 | 121.5 | $195,181 | Running | 1 | 2 |
| 4 | 16 | 17 | Matt Kenseth | Ford EcoBoost Ford | 267 | 41 | 1 | 110.7 | $166,231 | Running | 2 | 3 |
| 5 | 17 | 10 | Stewart Biffle | 3M Nexcel 1230 Ford | 267 | 39 | | 103.1 | $118,135 | Running | | |
| 6 | 2 | 29 | Kevin Harvick | Rheem Chevrolet | 267 | 38 | | 100.0 | $146,771 | Running | | |
| 7 | 7 | 88 | Dale Earnhardt Jr. | Diet Mountain Dew/National Guard Chevrolet | 267 | 37 | | 102.8 | $104,060 | Running | | |
| 8 | 9 | 5 | Kasey Kahne | Farmers Insurance Chevrolet | 267 | 36 | | 101.5 | $108,430 | Running | | |
| 9 | 21 | 99 | Carl Edwards | Aflac Ford | 267 | 35 | 1 | 87.7 | $133,301 | Running | 1 | 1 |
| 10 | 23 | 18 | Kyle Busch | M&M's Toyota | 267 | 34 | | 90.5 | $139,845 | Running | | |
| 11 | 11 | 2 | Brad Keselowski | Miller Lite Dodge | 267 | 34 | 1 | 90.1 | $121,405 | Running | 1 | 2 |
| 12 | 23 | 42 | Juan Pablo Montoya | Target Chevrolet | 267 | 33 | 1 | 88.3 | $121,101 | Running | 2 | 4 |
| 13 | 23 | 14 | Tony Stewart | Office Depot/Mobil 1 Chevrolet | 267 | 31 | | 78.3 | $133,335 | Running | | |
| 14 | 35 | 1 | Jamie McMurray | McDonald's Chevrolet | 266 | 30 | | 73.6 | $114,015 | Running | | |
| 15 | 1 | 22 | Aric Almirola | The Home Depot Toyota | 266 | 29 | | 66.2 | $93,365 | Running | | |
| 16 | 25 | 9 | Marcos Ambrose | DeWalt Ford | 266 | 28 | | 72.4 | $108,283 | Running | | |
| 17 | 14 | 51 | Kurt Busch | Phoenix Construction Services, Inc. Chevrolet | 266 | 27 | | 85.1 | $102,283 | Running | | |
| 18 | 19 | 27 | Paul Menard | Menards/Pella Chevrolet | 266 | 26 | | 65.1 | $88,783 | Running | | |
| 19 | 10 | 12 | Sam Hornish Jr. | Bell Dodge | 266 | 6 | | 73.0 | $79,950 | Running | 1 | 7 |
| 20 | 13 | 39 | Ryan Newman | Hass Automation Chevrolet | 265 | 24 | | 76.0 | $102,053 | Running | | |
| 21 | 20 | 24 | Jeff Gordon | Dow/Bud Mount Chevrolet | 264 | 23 | | 76.5 | $124,295 | Running | | |
| 22 | 12 | 31 | Jeff Burton | Caterpillar Chevrolet | 264 | 22 | | 85.0 | $116,285 | Running | | |
| 23 | 26 | 43 | Aric Almirola | STP Ford | 264 | 21 | | 39.8 | $116,545 | Running | | |
| 24 | 33 | 78 | Regan Smith | Furniture Row/Farm American Chevrolet | 263 | 20 | | 58.5 | $103,443 | Running | | |
| 25 | 35 | 83 | Travis Kvapil | Burger King Real Fast Smoothies Toyota | 263 | 19 | | 50.9 | $101,743 | Running | | |
| 26 | 45 | 13 | Casey Mears | GEICO Ford | 263 | 18 | | 42.8 | $90,018 | Running | | |
| 27 | 32 | 36 | David Gilliland | Front Row Motorsports Ford | 263 | 17 | | 50.6 | $87,607 | Running | | |
| 28 | 42 | 32 | Fred Sanfordi | 3D/Motor Vin Drive Service/Ds Lamb Ford | 263 | 5 | | 32.1 | $85,015 | Running | | |
| 29 | 18 | 15 | David Reutimann | Aspen Construction Chevrolet | 262 | 15 | | 52.7 | $77,470 | Running | | |
| 30 | 27 | 34 | David Ragan | Barrett-Jackson Ford | 262 | 14 | | 42.9 | $76,710 | Running | | |
| 31 | 31 | 49 | JJ Yeley | FSG Abandonds Toyota | 261 | 13 | | 35.7 | $73,018 | Running | | |
| 32 | 1 | 82 | Al Almendinger | AAA Dodge | 257 | 13 | 1 | 24.8 | $124,505 | Running | 1 | 44 |
| 33 | 3 | 56 | Mark Martin | Aspen's Chosen Machine Toyota | 255 | 11 | | 24.1 | $70,585 | Engine | | |
| 34 | 32 | 83 | Landon Cassill | Burger King Real Fast Smoothies Toyota | 215 | 10 | | 45.2 | $69,981 | Running | | |
| 35 | 38 | 37 | Bobby Labonte | Raser Technology Toyota | 182 | 9 | | 34.8 | $61,486 | Engine | | |
| 36 | 8 | 16 | Greg Biffle | 3-Man Energy Toyota | 128 | 8 | | 24.9 | $100,474 | Engine | | |
| 37 | 33 | 26 | Dave Blaney | Toronto Baldwin Racing Chevrolet | 92 | 7 | | 33.9 | $72,280 | Vibration | | |
| 38 | 34 | 38 | David Stremme | Inception Motorsports Toyota | 82 | 6 | | 31.2 | $72,051 | Overheating | | |
| 39 | 36 | 26 | Josh Wise | Moneytown Quikrete Service Ford | 68 | 5 | | 30.4 | $69,700 | Rear Gear | | |
| 40 | 37 | 98 | Michael McDowell | Cash Resources Ford | 18 | 4 | | 30.1 | $69,550 | Overheating | | |
| 41 | 41 | 87 | Joe Nemechek | AM/FM Energy, Wood & Pellet Stoves Toyota | 87 | 3 | | 27.4 | $69,450 | Vibration | | |
| 42 | 43 | 19 | Mike Bliss | Humphrey Smith Racing LLC Toyota | 27 | 2 | | 29.6 | $69,275 | Brakes | | |
| 43 | 34 | 23 | Scott Speed | North TX Pipe Chevrolet | 18 | 1 | | 29.3 | $69,040 | Rear Gear | | |

Race Comments: Before an estimated attendance of 75,000, Denny Hamlin won the STP 400, his 16th NASCAR Sprint Cup Series victory. Prior to the green flag, the following cars dropped to the rear of the field for the reason indicated: #20 engine changes.

Failed to Qualify: (3) 78 Tino Andrewson, 53 Jeff Green(i), 74 Terry Ramer

Time of Race: 2 Hrs, 48 Mins, 44 Secs. Average Speed: 144.122 MPH Margin of Victory: 0.700 Seconds

Caution Flags: 3 for 18 laps. Laps: 53-58 (#19 Spins Turn 4 [10]); 133-141 (Debris Backstretch [27]); 195-197 (Debris Turns 3 and 4 [29])

Lead Changes: 16 among 9 drivers: A. Almendinger 1-44; D. Hamlin 45; C. Edwards 46; M. Truex Jr. 47-51; J. Johnson 52-53; M. Kenseth 54; J. Montoya 55-99; M. Truex Jr. 97-127; M. Kenseth 128; B. Keselowski 129-160; M. Truex Jr. 161-223; J. Montoya 224-229; S. Hornish Jr (i) 229-232; M. Truex Jr. 233-236; D. Hamlin 237-267

Top 12 Driver Points: (1) G. Biffle 312 (2) M. Truex Jr. 297 (3) M. Kenseth 293 (4) D. Earnhardt Jr. 291 (5) D. Hamlin 289 (6) K. Harvick 287 (7) J. Johnson 279 (8) T. Stewart 265 (9) C. Edwards 251 (10) R. Newman 249 (11) C. Bowyer 227 (12) A. Sorbono 221

3M Lap Leader: Martin Truex Jr. #56 173 Laps — American Ethanol Green Flag Restart Award: Martin Truex Jr. #56

Coors Light Pole Award: Al Almendinger, #82 175.093 mph — DIRECTV Crew Chief of the Race: Danny Hamlin, #11 crew chief Darian Grubb Mobil Clevite Engine Builder of the Race: Toyota Racing Development (TRD), #56 — Mobil 1 Oil Driver of the Race: Denny Hamlin, #11

Moog Chassis Parts Problem Solver of the Race: J. Johnson, #48 C. Kinnon, 0.115 secs — USG Improving the Fairway: Juan Pablo Montoya, #42 37 places (i) Ineligible for driver points in this series

Next Race: Apr. 29, 2012 - Richmond International Raceway

NASCAR Integrated Marketing Communications @ P.O. Box 2275, Daytona Beach, FL 32120-2275

Fig. 3a

SPONSOR
AREA

*PLAY TO WIN*
2012 KANSAS STP 400
APRIL 22, 2012

FREE

2014 CORVETTE STINGRAY
WILL BE AWARDED BY (SPONSOR)!

Scratch off all 5 boxes on the back of this game card to reveal the starting positions of your team. Register by the end of LAP 40 to be eligible to win. If the starting positions revealed represent ALL the cars that finish in the top 5, a 2014 Corvette Stingray will be awarded by Houligan's!

Fig. 5a

SPONSOR
AREA

ENTER BY LAP 40! Scan the QR code or visit www.RDSPenter.com by the end of lap 40 to be eligible to win the car. All cards registered before the checkered flag will be entered in a second chance drawing. "Like" us on Facebook. The second chance winner will be revealed only on Facebook!

Start #'s :

Driver #'s :

RACE DAY SCRATCH PLAY

When you register, you'll be asked for the starting positions revealed along with the code just under the QR code. Complete rules can be found at www.RaceDayScratchPlay.com
info@racedayscratchplay.com • PATENTS PENDING 2012 Race Day Scratch Play, LLC

Fig. 5b

SPONSOR
AREA

*PLAY TO WIN*
2012 KANSAS STP 400
APRIL 22, 2012

FREE

2014 CORVETTE STINGRAY
WILL BE AWARDED BY (SPONSOR)!

Scratch off all 5 boxes on the back of this game card to reveal the starting positions of your team. Register by the end of LAP 40 to be eligible to win. If the starting positions revealed represent ALL the cars that finish in the top 5, a 2014 Corvette Stingray will be awarded by Houligan's!

Fig. 5c

SPONSOR
AREA

ENTER BY LAP 40! Scan the QR code or visit www.RDSPenter.com by the end of lap 40 to be eligible to win the car. All cards registered before the checkered flag will be entered in a second chance drawing. "Like" us on Facebook. The second chance winner will be revealed only on Facebook!

| | | | | | |
|---|---|---|---|---|---|
| Start #'s: | 12 | 2 | 31 | 27 | 5 |
| Driver #'s: | 31 | 29 | 49 | 34 | 55 |

RACE DAY SCRATCH PLAY

When you register, you'll be asked for the starting positions revealed along with the code just under the QR code. Complete rules can be found at www.RaceDayScratchPlay.com
info@racedayscratchplay.com • PATENTS PENDING 2012 Race Day Scratch Play, LLC

Fig. 5d

RaceDay: Thanks for entering!

raceday@vandrio.com

Sent: Sun 2/15/2013 8:38 AM

To: Cos@coslawton.com

RACE DAY SCRATCH PLAY

On behalf of RaceDay Scratch and Play, thanks for registering for your chance to win a 2014 Corevette Stingray in the upcoming Lucas Oil 200 on 2/16/2013 12:00:00 AM.

You registered the following starting positions for the race: 6, 31, 8, 29, 3. The unique control number assigned to your registration is 7670947. You'lineed both to claim your prize.

If you 'Liked' us on Facebook, keep monitoring for the several days after the race. We will be announcing the second chance winner of $2500 only on Facebook! If you see your name, respond back and we'll get in touch.

Finally as a way of saying thanks for playing, we've attached a money saving coupon you can use at your next visity. The coupon will expire thirty (30) days after the race.

Thanks for playing and Good Luck!

© Copyright by Race Day Scratch Play, LLC

See more about: raceday@vandrio.com

Fig. 7

RACE DAY SCRATCH PLAY GAME, GAME CARD AND METHOD OF PLAYING

This invention claims the benefit of priority to U.S. Provisional Patent Application Ser. No. 61/608,777 filed Mar. 9, 2012, the entire application of which is incorporated by reference.

FIELD OF INVENTION

This invention relates to games, in particular to scratch off game cards, systems and methods of play used for pre-picking winners of real time sporting events before the events take place, that include automobile racing events, such as but not limited to NASCAR®, stock car racing, rallying, drag racing, off-road racing, kart racing, Formula 1 racing, Indy-car racing, touring car racing, sports-car racing, production-car racing, one-make racing, horse racing, dog racing, camel racing and any other category of sporting event having a starting line-up.

BACKGROUND AND PRIOR ART

Scratch type lottery games have been popular over the years where a customer can purchase lottery type tickets from fast food, retail stores and vending machines then scratch off boxes to determine if they are an instant winner for money type prizes, and the like.

Other types of other scratch off games have been proposed over the years. See for example, U.S. Published Patent Application 2001/0019193 to Gumina and 2004/0193490 to Pletz. However, Gumina '193 is limited to using scratch off tickets to play card games such as poker, and blackjack, or casino games such as roulette, which determine an instant winner when the cards are physically scratched. Pletz '490 is limited to having selected merchants sponsor scratch off cards where instant prizes are also rewarded when the cards are scratched off.

A web based company uses a race scratch off card which involves one large card with 40 scratch off areas and lines for people to sign their names. When the card is full, they scratch off the cards to reveal their specific car. This same company markets a 10 player pole position game revealing four numbers per line next to the names. See Big Game Sports Cards (www.biggamesportscards.com/nascar).

The prior art is generally related to revealing a single number that would anticipate that number as the winner of the race, only. Other prior art would reveal four randomly selected numbers to win the pole (starting) position only.

None of the prior art is related to any type of scratch off game for fans of racing events, such as but not limited to NASCAR or Formula 1, in which they can randomly select a team of five drivers for which to support. The prior art is based on solely picking one winner, either of the pole or the race. None of the prior art expands the fans interest and knowledge of lesser known participants in the race. None of the prior art takes into consideration a particular number may fall out of the race, thus eliminating the possibility of a win. None of the prior art bases the winner on a team concept, just as the drivers are, for the most part, member of owner teams.

None of the prior art encourages corporate participation or support of the race tracks. None of the prior art has been designed for local dirt tracks as well as superspeedways and road courses.

Thus, the need exists for solutions to the above problems with the prior art.

SUMMARY OF THE INVENTION

A primary objective of the present invention is to provide a marketing game for collecting user personal information including name, email address and the like using scratch off game cards, systems and methods of play used by fans for pre-picking a personal team of up to five or more drivers to cumulatively dominate as winners of real time sporting events before the events take place, that include automobile racing events, such as but not limited to NASCAR®.

A secondary objective of the present invention is to provide scratch off game cards, systems and methods of play used by fans for pre-selecting teams of drivers of real time sporting events before the events take place, and having players compete with each other for additional prizes.

A third objective of the present invention is to provide versatile scratch off game cards, systems and methods of play used by fans for pre-selecting teams of drivers of real time sporting events before the events take place, to offer the players a plurality of different outcomes such as up to three or more outcomes that would have the players compete for additional prizes: a team instant winner based on starting positions, a team winner based on the final positions at the end of the race, and a race winner if the race winner is on a players card.

A fourth objective of the present invention is to provide versatile scratch off game cards, systems and methods of play used by fans for pre-selecting teams of drivers of real time sporting events before the events take place, to provide a platform for corporate sponsors to promote their products while offering an additional chance for players to vie for larger prizes. To protect the integrity of the playing cards, there are matching unique control numbers on the scratch off portion of the card as well as the "tear off" portion of the card.

A fifth objective of the present invention is to provide versatile scratch off game cards, systems and methods of play used by fans for pre-selecting teams of real time sporting events before the events take place, to provide a platform for corporate sponsors to promote their products while offering an additional chance for players to vie for larger prizes by entering the players personal information and the selected team names using the internet.

A preferred embodiment provides a sporting event card game that includes a plurality of game cards corresponding to a future real-time sporting event having a plurality of starting positions, a plurality of scratch-off spaces on the game card which each cover one of the plurality of starting positions in a random order, wherein players scratch off a selected number of the scratch-off spaces to reveal the selected number of members of the player's team, the selected number being less than the number of starting positions, a team fill in section on the game card for identifying the revealed player's team, player identification fill in portions for listing contact information for the player of the game card, and a finish position portion on the card for listing a final finishing position number for each revealed member of the player's teams after the sporting event has concluded, wherein the player having a lowest totals of the player's team members finish positions wins the sporting event card game. The sporting event card game can be an automobile racing event. The sporting event card game can be an animal racing event.

The team fill in portions and start position numbers are listed before the sporting event commences or can be listed before a pre-selected time during the real-time sporting event.

The sporting event game card can include a starting position fill in portions on the card for listing a start position corresponding to each revealed member of the player's team.

The lowest total of the start position numbers of the player's team can determine the winner of the sporting event card game.

The sporting event game card can include a website for entering the player social media data and the revealed player's team. The social media data can include a player's name, and a least one of an email address and a telephone number assigned to the player.

The sporting event game card can include a plurality of different control numbers each one assigned one of a plurality of game cards, wherein when two or more game cards have a same lowest totals of the player's team members finish positions a sum of a predetermined number of control number characters is used to break the tie.

The sporting event game card can include up to 50 scratch off portions on the card and less than five team members are selected by scratching off random spaces, by the players for each of the game cards. Alternatively, the game card can include up to five scratch off portions on the card, wherein each scratch off portion reveals the starting position of one member of the players team.

A second embodiment provide a method of playing a scratch off card game corresponding to a real time sporting event that includes the steps of providing a real-time sporting event having a first plurality of team members each assigned a starting position, the first plurality of team members competing with each other for the sporting event, providing a second plurality of game cards to a third plurality of players, each game card having a fourth plurality of scratch off sections which cover randomly selected and placed numbers corresponding to starting position for the sporting event, the second plurality being greater in number than the first plurality, scratching off a selected number of the scratch off sections to reveal a player's team, the selected number being less than the first plurality, filling in member numbers corresponding to each revealed starting position of the player's team, repeating the above steps for additional players, and determining a winner of the sporting event card game from the revealed starting positions of each one of the plurality of players.

The method of playing a scratch off card game can include the step of filling in each of the revealed starting position numbers of the player's team on the game card. The method of playing a scratch off card game can include the step of filling in finish position numbers for each of the selected members after the sporting event has concluded. Determining a winner can include the step of adding the finish position numbers for each of the members of the players team, the player having the lowest total finish position number winning the game. In the event of a tie, determining a winner can include assigning a different control number to each game card in the second plurality and adding two or more characters of the control number, the lowest total number determining a the winner breaking a tie.

Determining a winner can include determining a starting position winner from a respective player having the lowest sum of the starting position sum to be a winner of the racing event card game.

The team fill in positions and start position numbers can be listed before the sporting event commences. The team fill in positions and start position numbers can be listed before a designated time in the sporting event.

The method of playing a scratch off card game can include sponsoring a scratch off card game corresponding to a real time sporting event and offering a prize for the winner of the sponsored sporting event card game.

The method of playing a scratch off card game can include accessing a mobile sporting event scratch off game website from a mobile device, clicking on a click to play button to be directed to a player registration page, entering required social media information identifying the player to move to a next page, clicking on each displayed scratch off section to reveal starting positions of the members of the player's team, automatically entering the player's social media information, scratch off starting positions and a control number, and sending a registration confirmation to the player via one of an email message and a text message.

Further objects and advantages of this invention will be apparent from the following detailed description of the presently preferred embodiments which are illustrated schematically in the accompanying drawings.

BRIEF DESCRIPTION OF THE FIGURES

FIG. 3 shows an example of the unofficial results for the NASCAR® Sprint Cup® series race number 8, 2012 season.

FIG. 5*a* shows an example of a mass distribution sponsored game card as distributed.

FIG. 5*b* shows the scratch-off side of the game card shown in FIG. 6*a*.

FIG. 5*c* shows another example of a mass distribution sponsored game card as distributed.

FIG. 5*d* shows the scratch-off side of the game card with the scratch-off off starting numbers revealed and the driver number filled in by the player.

FIG. 7 shows an example of an email confirmation received by a player after registering a game card.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

The Race Day Scratch Play card systems and methods of the present invention employ scratch off technology in a card form or an electronic form. The Race Day Scratch Play card allows players to play competitive games while watching any live sporting event that has a starting lineup. The original game card can have up to approximately 50 scratch-off spaces.

One skilled in the art should realize that the particularities in the Race Day Scratch Play game card, method and system should not be construed as limitation of the preferred embodiment. Various system configurations and corresponding components may be chosen and optimized for a particular application to achieve a desired performance and other types of games and races, such as horse or dog races can be substituted. The race day scratch play game card can be configured for any real-time sporting event that has a starting line-up. While the individual rules may vary from game to game and sport to sport, the basic concept remains the same: scratch off the stated number of spaces and compete to win.

The Race Day Scratch Play card systems and methods when used for sponsored event uses the scratch off technology sold as a marketing package. The three main components involve a real-time sporting event, a large game card, a smaller game card for mass distribution, and a mobile website that can be accessed through Quick Response (QR) technology or by entering in the address into a web browser to reveal the same number of spaces as the small card. The sponsor can entice the fans to play the game by offering an appropriate grand prize. In return for having a chance at winning the grand prize and receiving a money saving coupon, the fans will register their cards with social information of interest to the sponsor. While the race day scratch play game card and website can be configured for any competitive sporting event that has a starting lineup, the game card, method and system is described using a race car event for purpose of illustration and not limitation.

Figure 1:
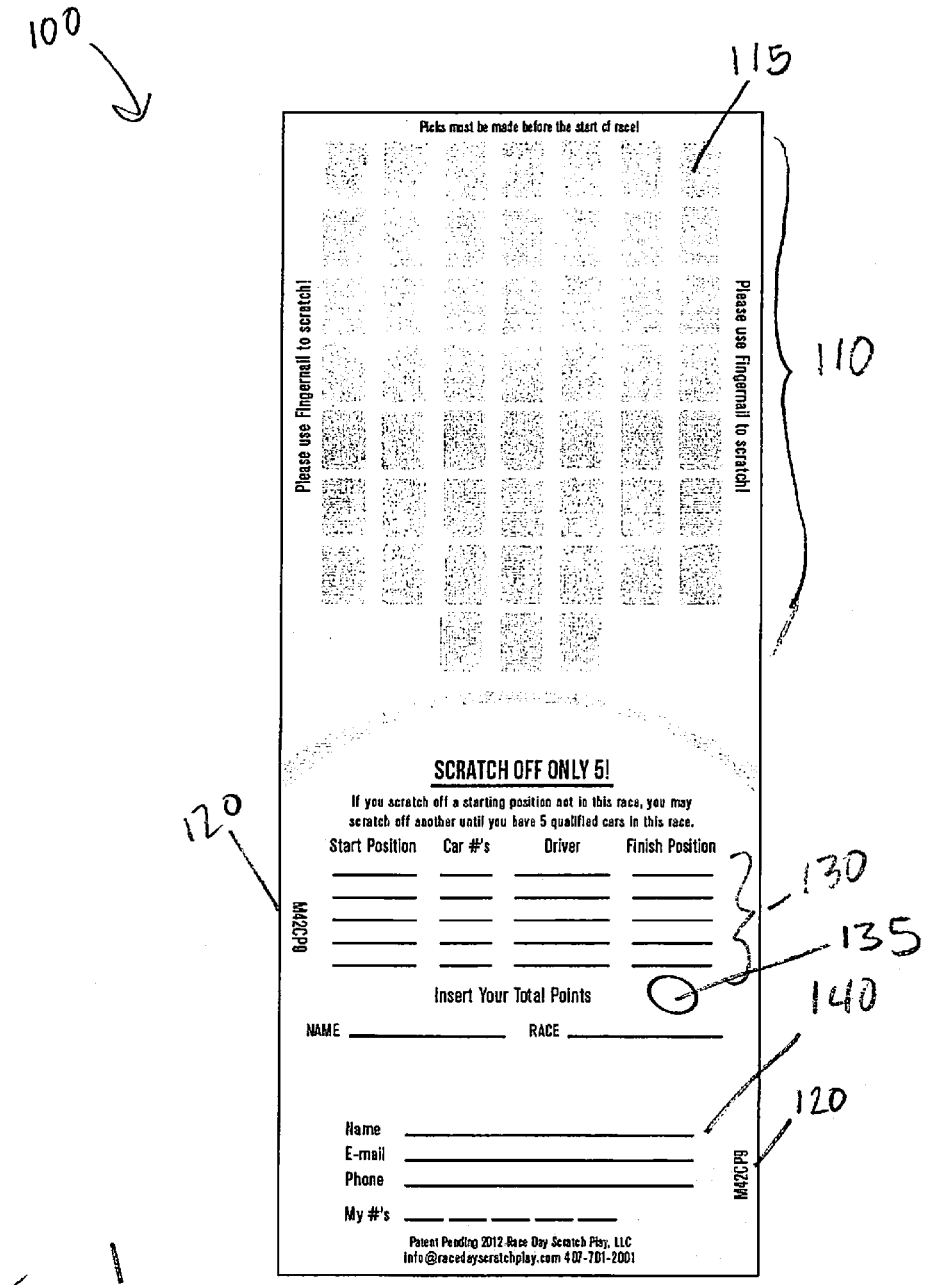
FIG. 1 shows an example of a Race Day Scratch Play game card according to an embodiment of the present invention.

FIG. 1 shows an example of a large size Race Day Scratch Play game card 100 for a race car event that is designed to play among race fans gathered to watch a live sporting event. Depending on the sport associated with the Race Day Scratch Play game card, the number of scratch off areas 110 will coincide with the number of scheduled starters. In the example shown, the card includes 52 individual scratch-off spaces 115 to allow the player to scratch off a predetermined number of spaces before the start of the race. Behind each scratch off area are numbers that represent each of the starting positions in the race, with each number listed only once.

When the cards are manufactured, the computer moves the numbers around so that it is virtually impossible to tell what number would be behind any individual space 115. The computer also places an alpha/numeric control code 120 on the card that can be used to verify the numeric positions on the entire card. This control code can also be used to break any tie.

From the time the fan receives the game card, the fan has until the official start of the race to scratch off the specified number of spaces, as instructed on the card and to register their card online with the sponsor or complete the registration spaces 140 on the card and return the fan section of the card to the sponsor before the start of the race. The starting position numbers revealed under the scratch-off represent the fan's "Team" for the race. On the game card, the fan writes the scratched off numbers under "Start Position" in the respective spaces 130 under the scratch off area. Once the order of the starting field has been determined, the fan can then fill in their team's numbers and names in the respective spaces 130.

Figure 2A:
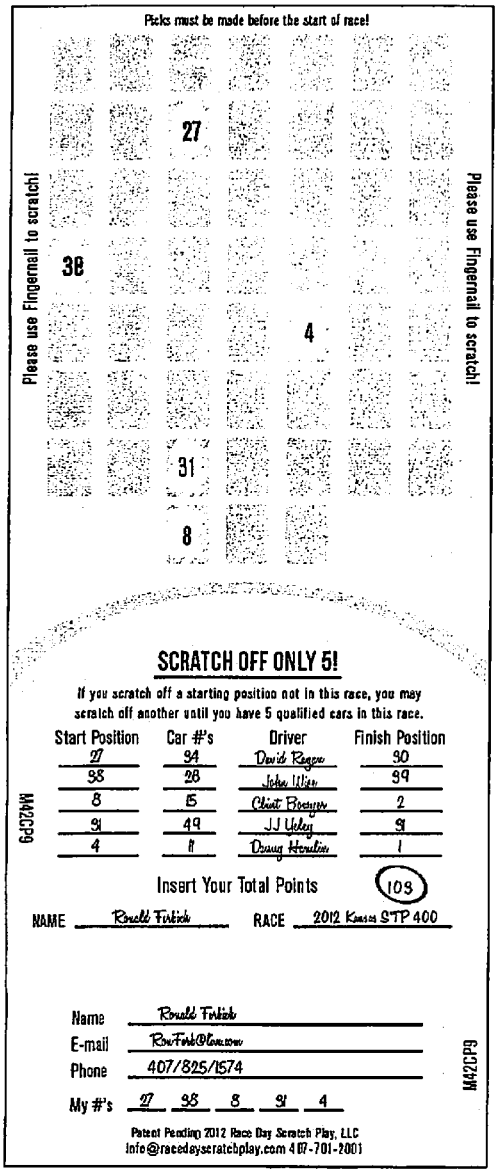
FIG. 2*a* shows a first example of a completed Race Day Scratch Play game card.
Figure 2B:
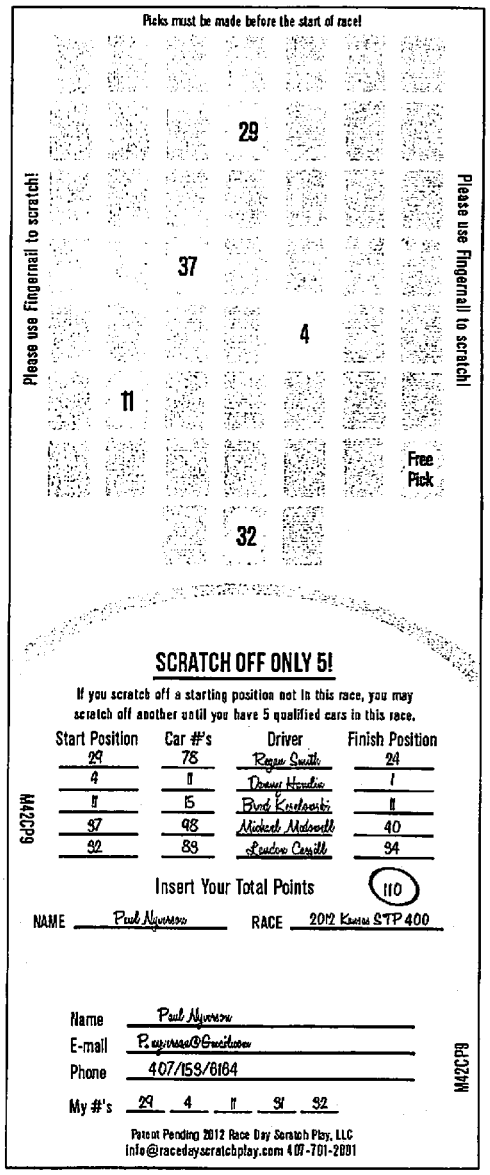
FIG. 2*b* shows a second example of a completed Race Day Scratch Play game card with a "free play".

FIGS. 2*a* and 2*b* show examples of four Race Day Scratch Play game cards. Should a scratch off reveal a starting position that is not in the race, the fan can scratch off another space as instructed on the card until five qualified cars have been selected.

Figure 2C:
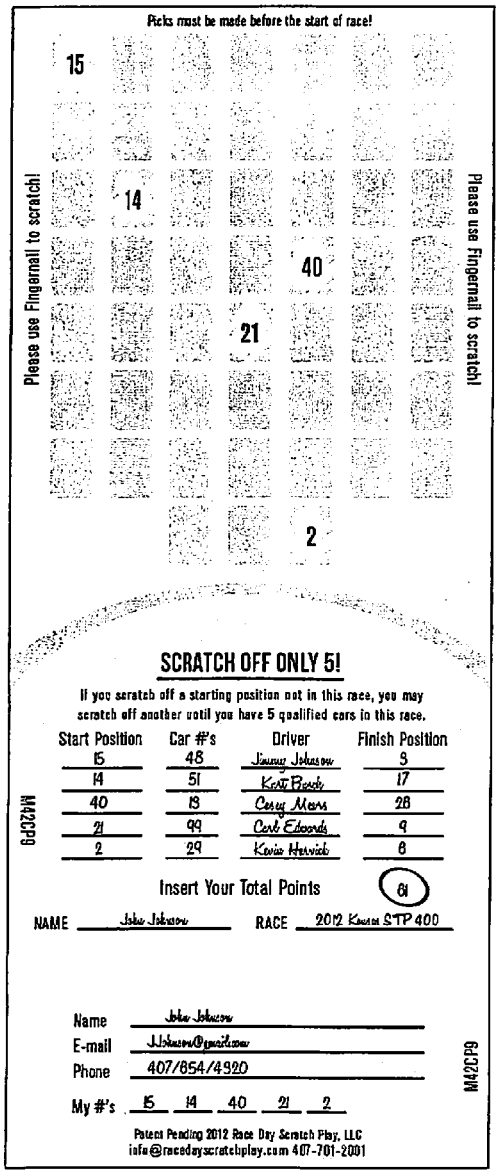
FIG. 2*c* shows an example of a winning Race Day Scratch Play game card.
Figure 2D:
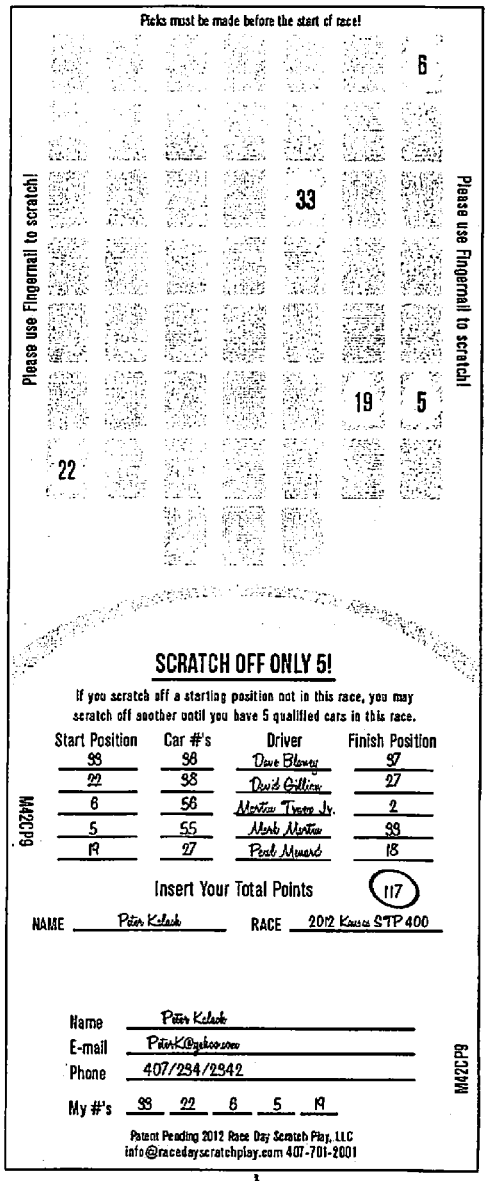
FIG. 2*d* shows a fourth example of a completed Race Day Scratch Play game card.

At the conclusion of the race, the fan inserts the finish positions in the proper lines on the game card. The finishing positions for the fan's Team are added together and the total number is inserted into the circle under Finish Position on the card. The card with the lowest cumulative score wins! In the Example shown in FIGS. 2*a*-2*d*, the winning card is shown in FIG. 2*c* with 61 total points. As previously discussed, the fan must enter his or her card prior to the start of the game to be entered to win and any card with more than five spaces revealed is disqualified if the excess revealed spaces are qualified cars. If the player is playing a sponsored race, the specified rules may vary.

FIG. 3 shows an example of unofficial results of a race. The results include reading from left to right, the starting position, the car number, the driver and the finish position that can be used by a fan to fill in the blanks on the card.

In the unlikely event of a tie, the last two numbers/letters of the control code can be used to select a winner. In this example, the alphabet is converted to numeric with "A" having the designation 1 and Z having the designation of 26. Add the last two alpha/numeric digits together; the lowest cumulative score can be deemed the winner. Alternatively, the control code can be a numerical number or alpha numeric with the last two or more characters being numerical for use in breaking the tie and determining which card is the wining card.

When a group of fans are watching the race together and each of the fans has a game card, they can play other games amongst themselves. For example, each of the fans in the group can add up the numerical starting positions and write the total points on your game card in the circle under the column Start Position. The fan with the lowest cumulative start position score can wins the pre-race competition within the group of fans.

The invention can include marketing and using the novel scratch off cards with corporate sponsors. Sponsorships can be licensed for each race weekend, and can include more than one sponsor. The card can be customized for the race weekend and the card games can be handed out to all the race fans as they enter the race track. In this embodiment, the Race Day Scratch Play game cards are used by a sponsor as a marketing tool to allow customer/clients of the sponsor to play and participate in a sponsored game. A sponsored game card event can be made up of more than one component each utilizing the scratch off technology. In this example, the three main components involve a large game card; a smaller, mass distribution game card; and a mobile website.

The large game card can be similar to the Race Day Scratch Play game card described above and shown in FIG. 1 having approximately 50 scratch-off spaces. The smaller, mass distribution game card can be a card that would easily fit in a fan's shirt pocket or smaller with each smaller card having a significantly fewer number of scratch-off spaces. The mobile website can be accessed through Quick Response (QR) technology or by entering in the address into a web browser. The mobile website can reveal the same number of spaces as the small card.

The sponsor can entice the fans to play the game by offering an appropriate grand prize. In return for having a chance at winning the grand prize and/or receiving a money saving coupon, the fans register their game cards with social information of interest to the sponsor. While the rules, layout and adaptation may vary depending on the selected sporting event, the general concept remains the same as the original card. The fan scratches off the stated number of positions to reveal his or her team. How the fan's Team finishes the race determines the fans success and potential for winning a prize.

For purposes of illustration and not limitation, the following is a description of how to play a NASCAR® Sprint Cup Sponsored Race. A specified race can be licensed to the Sponsor from Race Day Scratch Play. In this embodiment, there are three ways to play as discussed above, a fan card, a mass distribution card and through the use of a mobile website. Registering a large fan card or a small mass distribution game card puts the fan's entry in the same competition as the mobile website method. As described above, a sponsored event can include one type of entry or can include two or more types of entries.

Figure 4A:
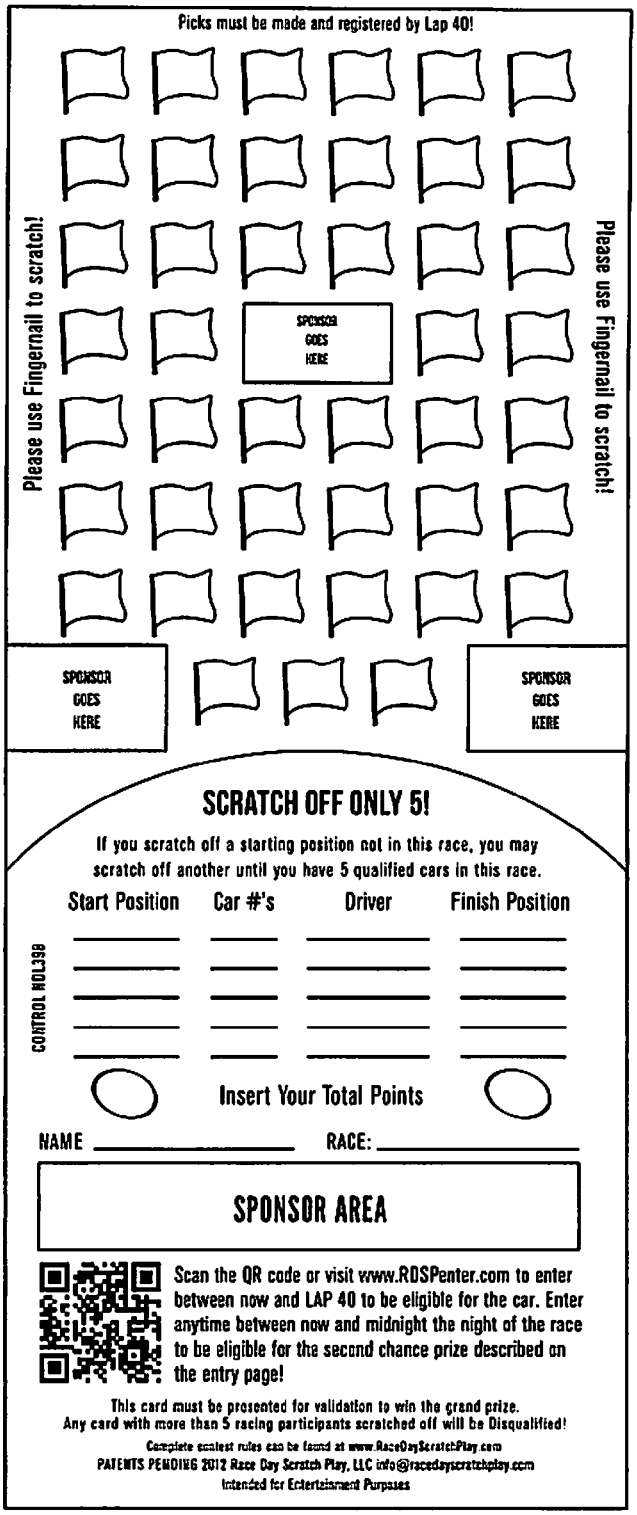
FIG. 4*a* shows an example of an unplayed game card with 43 flag scratch-off spaces.
Figure 4B:
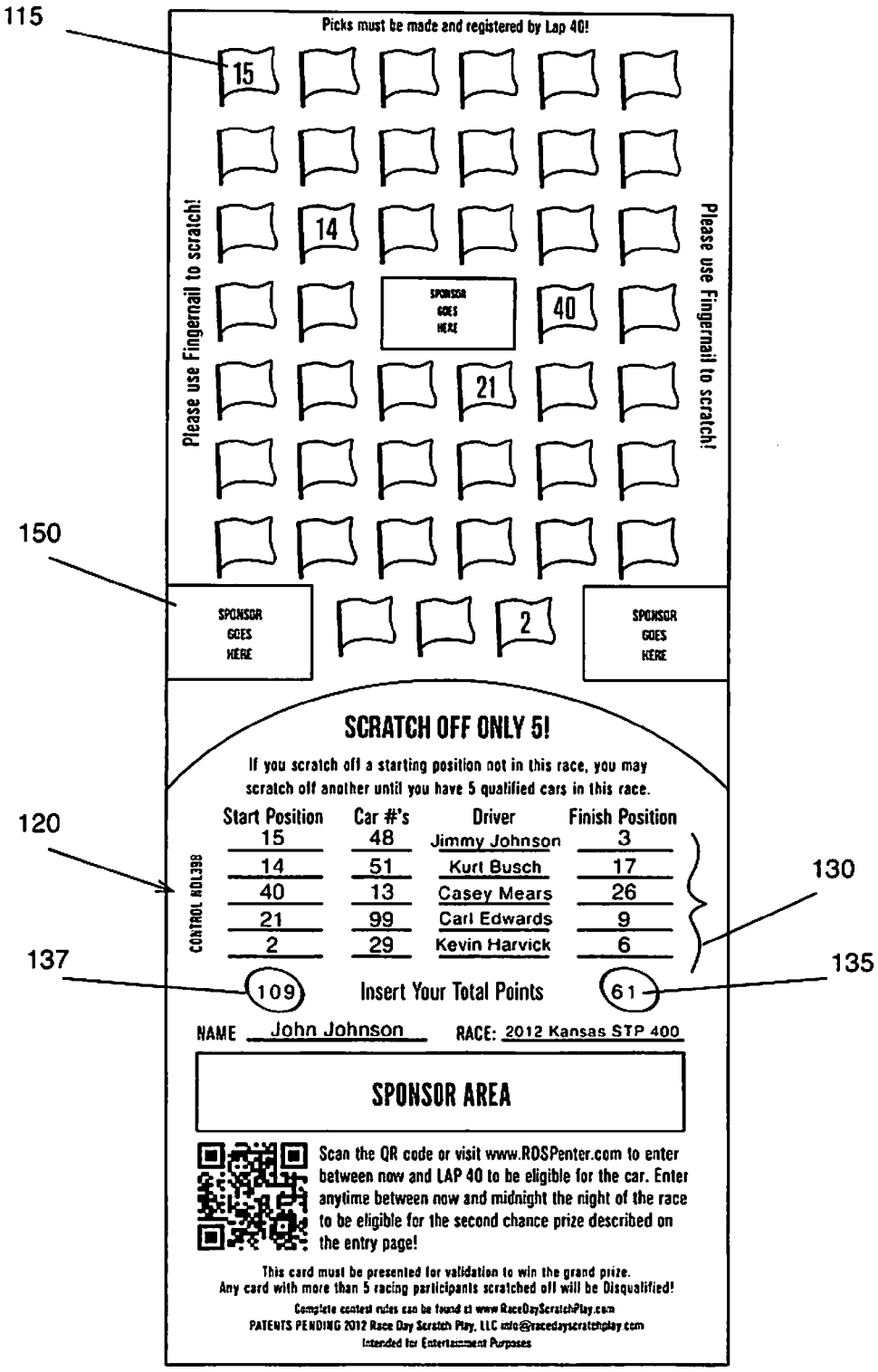
FIG. 4*b* shows an example of a played game cards with 43 flag scratch-off spaces.

FIGS. 4*a* and 4*b* show examples of fan game cards each having 43 flag scratch-off spaces. The function of the large fan game card is for the use of fans at the actual venue, or anywhere fans gather to watch the sponsored race. Participants playing the sponsored game event are given a large scratch-off game card. The number of scratch off areas will coincide with the number of scheduled starters in the sponsored event. Behind each scratch off area is a number with each number listed only once on the card. Each number represents one of the starting positions (in NASCAR Sprint Cup® or Nationwide Series®, that number is 43) in the race.

FIG. 4*a* shows an example of an unplayed game card with 43 flag scratch-off spaces. As shown, the game card can include spaces with the sponsor's name 150 and can include a "Sponsor Area" that directs the player to the sponsor's website to enter the sponsored game.

FIG. 4*a* shows an example of a played game card showing 5 scratched-off spaces and information about the player's team written in the provided blank spaces 130. In the example, shown, the game consists of a winning number for "start position" and for "finish position".

In another embodiment, the function of the game is for the mass distribution to the Sponsors customers at the sponsor's business locations, distribution to potential customers at the race, or other method of distribution determined by the sponsor. FIGS. 5*a* and 5*c* show examples of a cover side of a mass distribution sponsored game card as distributed by the sponsor to players. In this example, participants playing the mass distribution game are given a 5 scratch off game card as shown in FIG. 5*b*.

The player scratches off all the five flags. The numbers revealed will represent the fan's Team for the race. FIG. 5*d* shows the scratch-off side of the game card with the scratch-off starting numbers revealed and the driver number filled in by the player. The numbers behind the scratch off areas coincide with the number of scheduled starters each representing one of the starting positions in the sponsored event. As described in regard to the large game card, when the cards are manufactured, the computer moves the numbers around so that it is virtually impossible to tell what number would be behind what space. The computer also places an alpha/numeric control number on the card that can verify the numeric positions of the entire card, for verification purposes.

For the fan card distribution and the mass distribution game card, the sponsor could distribute game cards in advance, for example up to a month in advance of the sponsored event. From the time the player receives the game card, they have until the designated lap of the race to scratch off the specified number of spaces (five in the case of NASCAR Sprint Cup® or Nationwide Series®). In order to qualify for the Sponsor promotions, the fan must register their race team and control number by the time or lap specified in the rules. This can be accomplished by scanning the QR code printed at the bottom of their game card or using a web browser to type in the address listed on the card for registration.

Figure 6:
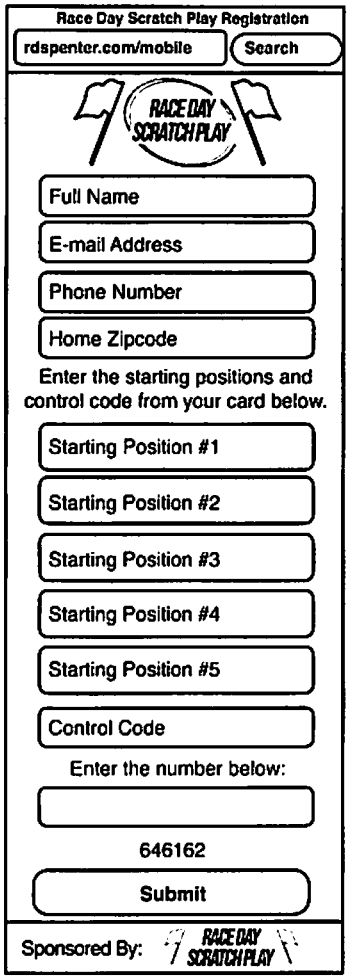
FIG. 6 shows an example of the registration site for both size game cards.

FIG. 6 shows an example of a registration site for the Race Day Scratch Play fan card or mass distribution game card. The player enters the sponsored game registration page shown in FIG. 6 which requests specific social media information about the player such as name, email address, phone number. The player also enters the starting positions and the control code from their individual game card. Optionally, the player can elect to be directed to a site listing all the rules and regulations (not shown) for this particular event including a list of prizes.

Once the card is registered, the player can receive an email confirmation as shown in FIG. 7 and/or text message confirming their Team, control code and optionally a money saving reward from the Sponsor. This registration MUST be completed between the time the player receives the card and the end of the lap specified in order to be eligible for the grand prize.

After registering, the fan may complete the game card by filling in the relevant team positions 130 below the scratch off area. Once the qualifying order has been determined, the fan will then fill in their team's numbers and names. At the conclusion of the race, the player inserts the finish position in the proper location on the game card for total points 135. If a fan's team finishes the race as the top five finishers, that fan qualifies for a chance of winning the grand prize! As described in the previous example, in the unlikely event of a tie, the last two numbers/letters of the control code will be used to break the tie by converting the alphabet to numeric with "A" having the designation 1 and Z having the designation of 26 and adding the last two alpha/numeric digits together; the lowest cumulative score will be deemed the winner.

In the preferred embodiment, the sponsor is only required to give away one grand prize per race however; the sponsor can choose to add additional competitive game card entries and prizes. Optional ways to win can include adding up the starting positions and insert the total points on your game card. In this option, the player with the lowest cumulative score wins the pre-race competition. In another option, the player that has the card that is leading at the halfway point in the race can be a winner.

As shown in FIG. 7, the sponsor can elect to include alternative options for winning other game prizes in the email or text message confirmation. In the example shown in FIG. 7, the sponsor provides a method of being a second chance winner by liking the sponsor on a social media website such as Facebook® and the like. Another option the sponsor can provide is a link to receive a money saving coupon. For the optional chances to win, the email or text message confirmation includes a game expiration date. The Race Day Scratch Play game can involve entry via a mobile website. In this embodiment, at the invitation of the sponsor, the player can access to a Mobile Website an additional way to play and compete. Once licensed to the Sponsor, the mobile website makes any race relevant—anywhere in the world. Through the use of a posted URL address or the QR technology, the race fan is directed to the mobile website landing page. This page will indicate the Sponsored grand prize as well as any additional prizes for a specified race.

Figure 8A:
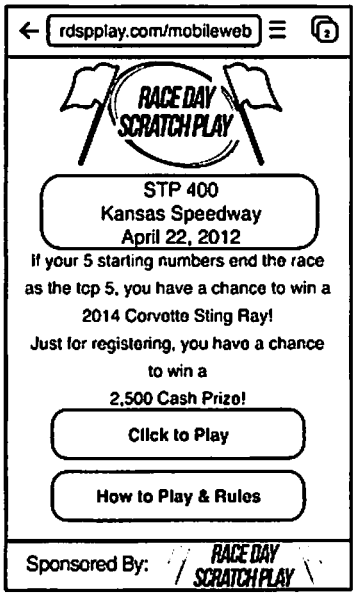
FIG. 8*a* shows an example of a mobile website page for a sponsored game event.
Figure 8B:
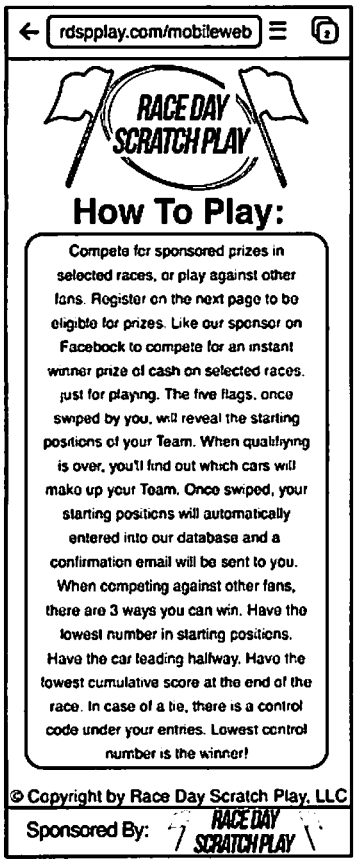
FIG. 8*b* shows the How To Play information for FIG. 8*a*.

FIG. 8*a* shows an example of a mobile website page for a sponsored game event. Clicking on the click to play button takes the fan directly to the registration page shown in FIG. 8*b*. Clicking on How to Play & Rules icon takes the fan to the page giving all the instructions and rules in a synopsis view as shown by example in FIG. 8*c*. A URL can also be posted in the synopsis to allow the fan to obtain the full, expanded set of rules for the game. The instructions and the rules are shown for illustration only and can be modified to meet the needs of the sponsor.

Figure 8C:
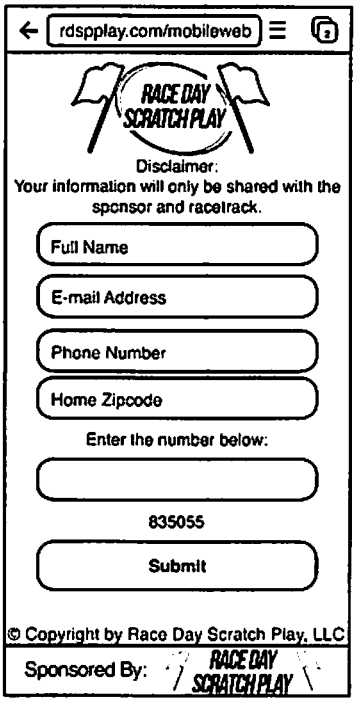
FIG. 8*c* shows the registration page for FIGS. 8*a* and 8*b*.

After clicking on "click to play", the fan is directed to the registration page as shown in FIG. 8*c*. The fan is requested to enter sponsor requested social media information on this page along with the alpha-numeric code provided on the screen to insure a live human, not a computer generated program, is entering the social media information.

Figure 9A:
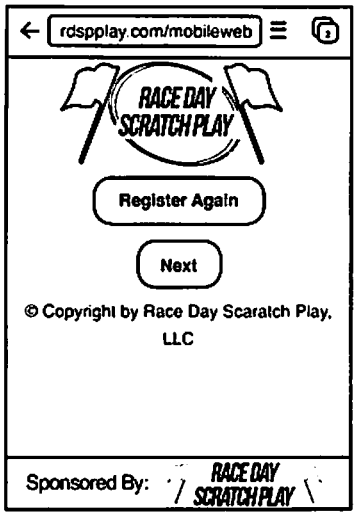
FIG. 9*a* show a screen shot of the mobile website for plying the Race Day Scratch Play game.
Figure 9B:
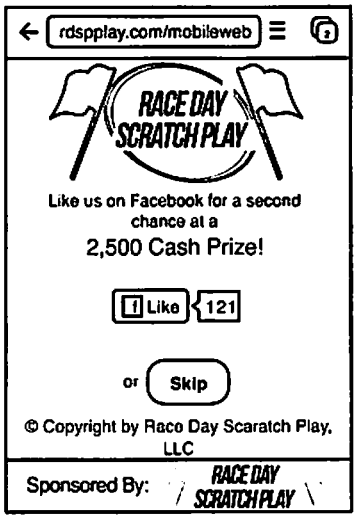
FIG. 9*b* shows a next screen shot giving the fan an opportunity to "like" the Sponsor on a social media website.

Clicking on either the "Like" or "Skip" button takes the fan to the actual game page. FIGS. 9*a*-9*f* show screen shots of the mobile website for plying the Race Day Scratch Play game. If a fan has already played the game on the same device, the mobile website only allow a new registration with different set of social media information or requires the fan to move to the Next page as shown in FIG. 9*a*. As shown in FIG. 9*b*, the Next button gives the fan an opportunity to "like" the Sponsor on a social media website. In return for liking the sponsor on the social media website, the fan is entered in a second chance prize drawing. Regardless the outcome of the fan's team, the fans that "like" the Sponsor will be entered for this drawing. Optionally, the fan has the opportunity to Skip this part of the registration.

Figure 9C:
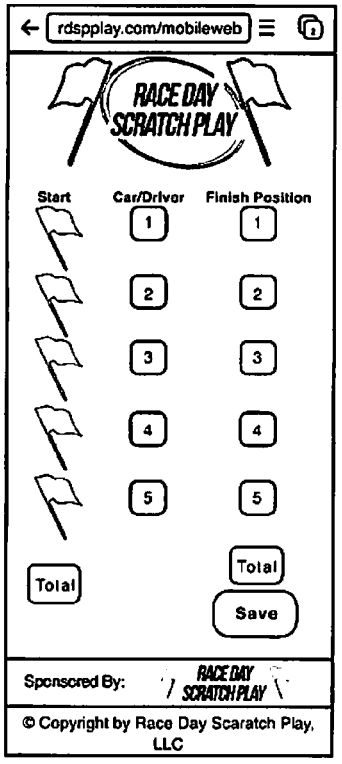
FIG. 9*c* shows a screen shot with five scratch-off flags along with a control number.
Figure 9D:
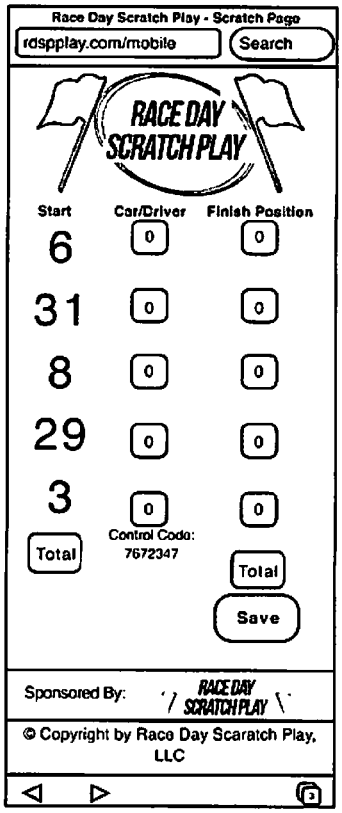
FIG. 9*d* shows a screen shot with the fans team revealed.
Figure 9E:
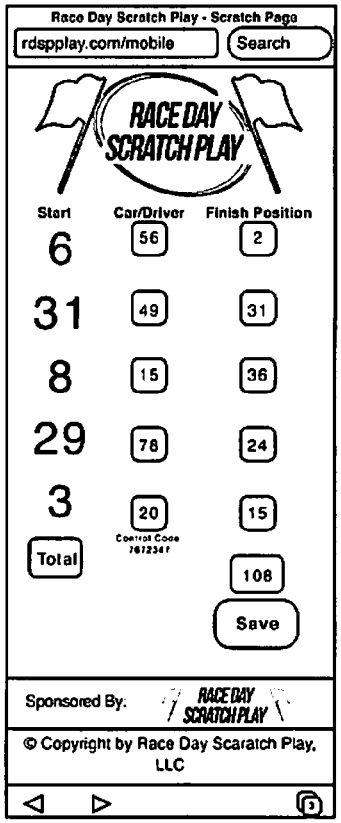
FIG. 9*e* shows a screen shot with the corresponding driver numbers and finish position revealed.
Figure 9F:
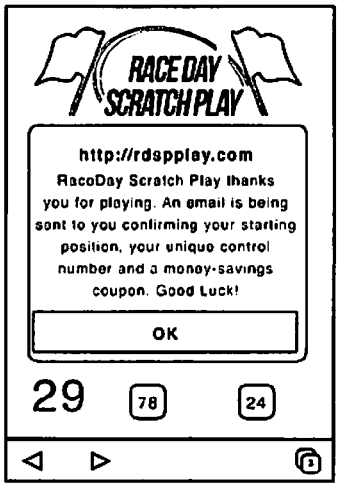
FIG. 9*f* shows a final screen shot confirming entry into the race day scratch play game.

FIG. 9*c* shows a screen shot with five scratch-off flags along with a control number. The fan actually "scratches off" the five flags by clicking the five individual flags to reveal the fans team as shown in FIG. 9*d*. The cumulative starting position of the team is automatically added by the program. Once qualifying for the particular race is official, the fan can then enter the corresponding driver numbers as shown completed in FIG. 9*e* and later, the finishing positions. If they click Save, the entries work will be retained.

Once the team is revealed, the starting positions, control number and registration are automatically entered into the race database. A screen confirming the fan's participation in the game is automatically displayed to the fan. Shortly thereafter, the fan also receives an email from the Sponsor confirming their participation. The email confirmation includes the fan's team and control number. In appreciation for their participation, the sponsor can also attach a money savings coupon to the confirmation email.

Additional features can include bar code type scanable features on the card where the player can win sponsor supported prizes if all their 5 numbers end up in the top 5 for this race.

The cards can be used for groups to play in the stands, at bars, and the like. Through the use of smart phones, fans not at the event can also participate, with the approval of the other participants, by sending their game side photo to the moderator of the game. There are always pools in the stands and this takes picking your favorite out of the equation. The invention has been test marketed at the Daytona 500 race track and had a great response from fans.

Figure 10A:
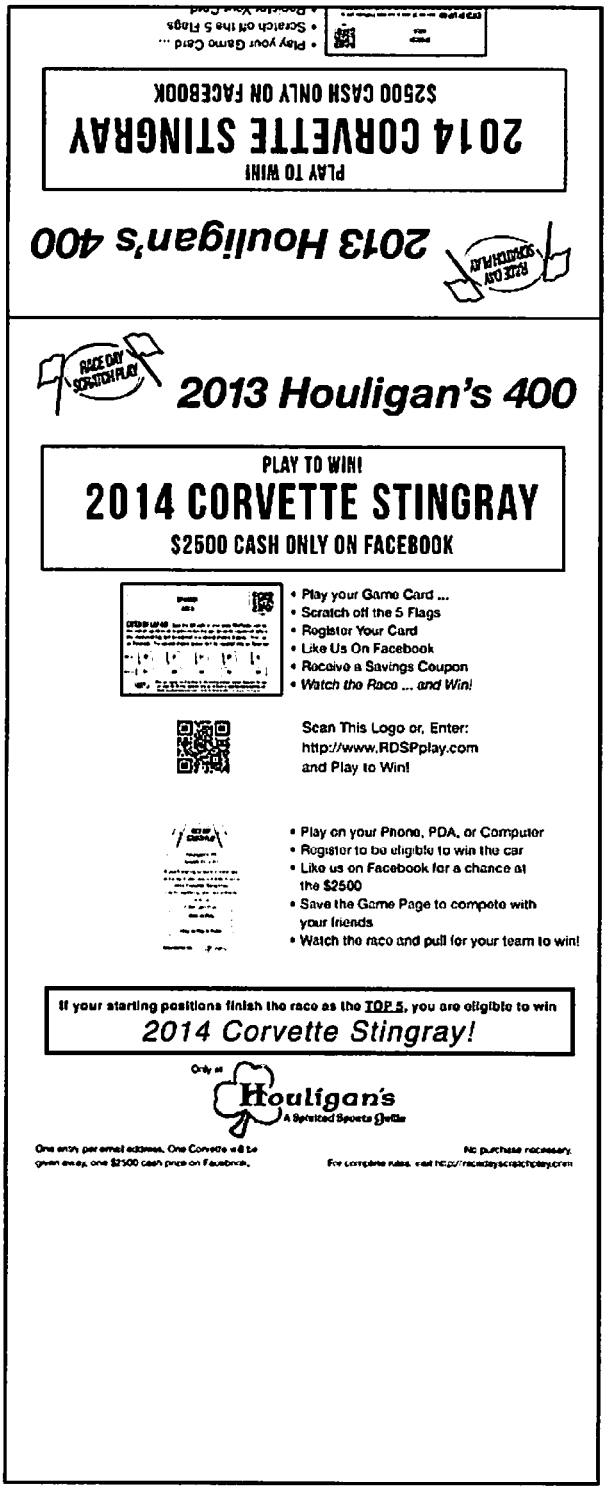
FIG. 10*a* shows an example of a table tent card to promote the game.
Figure 10B:
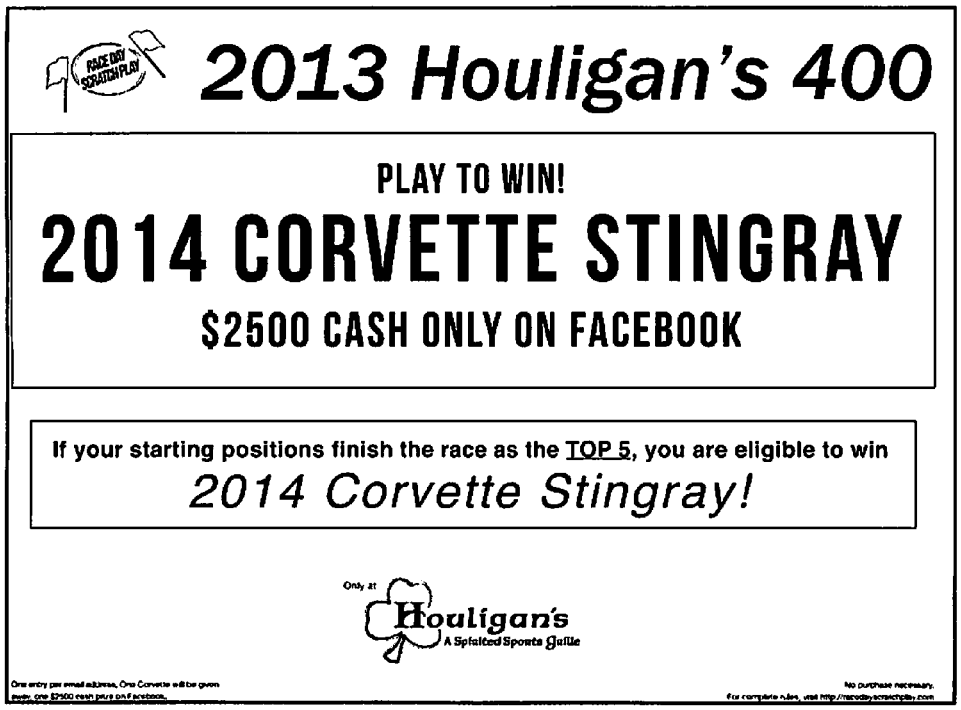
FIG. 10*b* shows an example of a hanging banner that can be used by the sponsor to promote the game.

Optionally, the sponsor can use support material for the sponsored Race Day Scratch Play game. FIG. 10*a* shows an example of a table tent card and FIG. 10*b* shows an example of a hanging banner that can be used by the sponsor to promote the game.

For example, 50,000 customized scratch-off cards can be provided for a set licensing fee with deals on more volume for the weekend. Each weekend there are typically two to three races per race weekend at the same track, all on different days that could require new sets of cards.

Although the embodiment uses the cards for a car racing event, the invention cards can be used for other sporting events where there are multiple competitors in a single event, such as but not limited to boat racing events, golf events, swimming race events, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A sporting event card game, comprising:

a plurality of game cards corresponding to a future real-time sporting event having a plurality of starting positions;

a plurality of scratch-off spaces on the game card which each cover one of the plurality of starting positions in a random order, wherein players scratch off a selected number of the scratch-off spaces to reveal the selected number of members of the player's team, the selected number being less than the number of starting positions;

a team fill in section on the game card for identifying the revealed player's team;

player identification fill in portions for listing contact information for the player of the game card; and a finish position portion on the card for listing a final finishing position number for each revealed member of the player's teams after the sporting event has concluded, wherein the player having a lowest totals of the player's team members finish positions wins the sporting event card game.

2. The sporting event game card of claim 1 wherein the team fill in portions and start position numbers are listed before the sporting event commences.

3. The sporting event game card of claim 1 wherein the team fill in portions and start position numbers are listed before a pre-selected time during the real-time sporting event.

4. The sporting event game card of claim 1 further comprising:

a starting position fill in portions on the card for listing a start position corresponding to each revealed member of the player's team.

5. The sporting event game card of claim 4 further comprising:

a lowest total of the start position numbers of the player's team wins the sporting event card game.

6. The sporting event card game of claim 1, wherein the racing event is an automobile racing event.

7. The sporting event card game of claim 1, wherein the racing event is a horse racing event.

8. The sporting event card game of claim 1, wherein the player identification fill in portion comprises:

a website for entering the player social media data and the revealed player's team.

9. The sporting event card game of claim 1, wherein the social media data comprises:

a player's name; and a least one of an email address and a telephone number assigned to the player.

10. The sporting event game card of claim 1 further comprising:

a plurality of different control numbers each one assigned one of a plurality of game cards, wherein when two or more game cards have a same lowest totals of the player's team members finish positions a sum of a predetermined number of control number characters is used to break the tie.

11. The sporting event card game of claim 1, wherein the game card includes:

up to 50 scratch off portions on the card; and less than 10 team members are selected by scratching off random spaces, by the players for each of the game cards.

12. The sporting event card game of claim 1, wherein the game card includes:

up to five scratch off portions on the card, wherein each scratch off portion reveals the starting position of one member of the players team.

13. A method of playing a scratch off card game corresponding to a real time sporting event, comprising the steps of:

providing a real-time sporting event having a first plurality of team members each assigned a starting position, the first plurality of team members competing with each other for the sporting event;

providing a second plurality of game cards to a third plurality of players, each game card having a fourth plurality of scratch off sections which cover randomly selected and placed numbers corresponding to starting position for the sporting event, the second plurality being greater in number than the first plurality;

scratching off a selected number of the scratch off sections to reveal a player's team, the selected number being less than the first plurality;

filling in member numbers corresponding to each revealed starting position of the player's team;

repeating the above steps for additional players; and determining a winner of the sporting event card game from the revealed starting positions of each one of the plurality of players.

14. The method of claim 13 further comprising the step of:

filling in each of the revealed starting position numbers of the player's team on the game card.

15. The method of playing a scratch off card game of claim 14 wherein determining a winner comprises the step of:

determining an starting position winner from a respective player having the lowest sum of the starting position sum to be a winner of the racing event card game.

16. The method of playing a scratch off card game of claim 13 further comprising the step of:

filling in finish position numbers for each of the selected members after the sporting event has concluded.

17. The method of playing a scratch off card game of claim 16 wherein determining a winner comprises the step of:

adding the finish position numbers for each of the members of the players team, the player having the lowest total finish position number winning the game.

18. The method of playing a scratch off card game of claim 17 wherein determining a winner further comprises the step of:

assigning a different control number to each game card in the second plurality; and adding two or more characters of the control number, the lowest total number determining a the winner breaking a tie.

19. The method of playing a scratch off card game of claim 13 wherein the team fill in positions and start position numbers are listed before the sporting event commences.

20. The method of playing a scratch off card game of claim 13 wherein the team fill in positions and start position numbers are listed before a half-time in the sporting event.

21. The method of playing a scratch off card game of claim 13 further comprising the step of:

sponsoring a scratch off card game corresponding to a real time sporting event; and offering a prize for the winner of the sponsored sporting event card game.

22. The method of playing a scratch off card game of claim 13 further comprising the steps of:

accessing a mobile sporting event scratch off game website from a mobile device;

pushing a click to play button to be directed to a player registration page;

entering required social media information identifying the player to move to a next page;

clicking on each displayed scratch off section to reveal starting positions of the members of the player's team;

automatically entering the player's social media information, scratch off starting positions and a control number; and sending a registration confirmation to the player via one of an email message and a text message.

* * * * *